US009869131B2

(12) United States Patent
Williams et al.

(10) Patent No.: US 9,869,131 B2
(45) Date of Patent: Jan. 16, 2018

(54) DRILL BIT

(71) Applicant: NOV Downhole Eurasia Limited, Stonehouse, Gloucestershire (GB)

(72) Inventors: Stephen Williams, Stroud (GB); Denise John, Cheltenham (GB); Ryan Graham, The Woodlands, TX (US)

(73) Assignee: NOV Downhole Eurasia Limited, Gloucestershire (GB)

( * ) Notice: Subject to any disclaimer, the term of this patent is extended or adjusted under 35 U.S.C. 154(b) by 304 days.

(21) Appl. No.: 14/761,244

(22) PCT Filed: Jan. 8, 2014

(86) PCT No.: PCT/GB2014/050041
§ 371 (c)(1),
(2) Date: Jul. 15, 2015

(87) PCT Pub. No.: WO2014/111690
PCT Pub. Date: Jul. 24, 2014

(65) Prior Publication Data

US 2015/0345228 A1 Dec. 3, 2015

(30) Foreign Application Priority Data

Jan. 16, 2013 (GB) ..... 1302379.1

(51) Int. Cl.
*E21B 10/43* (2006.01)
*E21B 10/26* (2006.01)
(Continued)

(52) U.S. Cl.
CPC ..... *E21B 10/43* (2013.01); *E21B 10/26* (2013.01); *E21B 10/55* (2013.01); *E21B 2010/545* (2013.01)

(58) Field of Classification Search
CPC ..... E21B 10/43; E21B 10/48; E21B 10/26; E21B 10/55; E21B 2010/545; E21B 2010/425
See application file for complete search history.

(56) References Cited

U.S. PATENT DOCUMENTS 4,991,670 A 2/1991 Fuller
5,549,171 A * 8/1996 Mensa-Wilmot ..... E21B 10/43 175/431
(Continued)

FOREIGN PATENT DOCUMENTS

EP 0884449 12/1998
EP 2156002 2/2010
(Continued)

OTHER PUBLICATIONS

International Search Report for PCT/GB2014/080041 dated Oct. 21, 2014.
(Continued)

*Primary Examiner* — Michael R Wills, III
(74) *Attorney, Agent, or Firm* — Andrus Intellectual Property Law, LLP

(57) ABSTRACT

A drill bit comprises at least one blade, comprising a plurality of cutting elements in the form of polycrystalline diamond cutters disposed on a leading edge of the blade, at least one diamond impregnated cutting region, disposed behind the leading edge of the blade, and wherein at least one of the cutters disposed on the leading, edge is an off-tip cutting element, arranged so that it does not engage with the formation during drilling until bit wear has taken place.

15 Claims, 8 Drawing Sheets

(51) Int. Cl.
*E21B 10/55* (2006.01)
*E21B 10/54* (2006.01)

(56) References Cited

U.S. PATENT DOCUMENTS

| | | | | |
|---|---|---|---|---|
| 2007/0267227 | A1* | 11/2007 | Mensa-Wilmot | E21B 10/43 175/426 |
| 2009/0084606 | A1 | 4/2009 | Doster | |
| 2010/0175930 | A1 | 7/2010 | Schwefe | |
| 2010/0270077 | A1 | 10/2010 | Huynh et al. | |
| 2012/0031671 | A1* | 2/2012 | Propes | E21B 10/08 175/57 |

FOREIGN PATENT DOCUMENTS

| | | |
|---|---|---|
| GB | 2378718 | 2/2003 |
| WO | 2008124572 | 10/2008 |
| WO | 2011057303 | 5/2011 |

OTHER PUBLICATIONS

Search Report for GB1223422.5 dated Mar. 27, 2013.
Search Report for GB1400252.1 dated Jul. 1, 2014.
International Search Report and Written Opinion for PCT/GB2014/050041 dated Nov. 10, 2014.

* cited by examiner

DRILL BIT

CROSS REFERENCE TO RELATED APPLICATIONS

The present application is the U.S. national stage application of International Application No. PCT/GB2014/050041, filed Jan. 8, 2014, which international application was published on Jul. 24, 2014, as International Publication No, WO2014/111690. The International Application claims priority of British Patent Application No. 1302379.1, filed Jan. 16, 2013, the contents of which are incorporated herein by reference in their entireties.

FIELD

This invention relates to a rotary drill bit, and more particularly to a rotary drill bit suitable for forming boreholes through geologic formations.

BACKGROUND

Rotary drill bits are known in which a plurality of fixed cutting elements are used to cut through a rock formation, thereby forming or enlarging a bore. In some drill bits, cutting elements comprising polycrystalline diamond compacts (PDCs) and/or thermally stable polycrystalline (TSP) diamond are used. In such arrangements, a bit body is typically provided which is shaped to define a series of upstanding blades. A plurality of cutting elements is mounted to each blade, for example by being brazed into pockets formed thereon. Drill bits of this type are described in, for example, U.S. Pat. No. 4,554,986. Such polycrystalline diamond cutting elements provide high rates of penetration, but can be prone to damage and wear, particularly when drilling conglomerates or formations that include chert. An alternative to the use of polycrystalline cutting elements is to use a diamond impregnated metal matrix material in the formation of the bit body so as to form the body with regions serving, in use, as cutters to remove formation material. Drill bit of this general type are described in U.S. Pat. No. 6,843,333 and U.S. Pat. No. 6,510,906. Diamond impregnated cutting regions are typically tougher than PDC cutting elements, but have lower rates of penetration.

U.S. Pat. No. 6,296,069 describes a drill bit having polycrystalline diamond compact cutters mounted on the blades thereof, and having thermally stable synthetic diamonds and impregnated diamonds located elsewhere on the bit body. U.S. Pat. No. 6,009,962 discloses a drill bit comprises a bit body defining a series of blades with cutting elements mounted upon the blades, the leading surfaces of the blades being impregnated with abrasive particles.

WO2011/057303 describes an arrangement in which backup cutters are arranged behind and to follow associated primary cutters at a reduced cutting height.

It would be desirable to improve drill bit performance, for example by enhancing wear characteristics and rates of penetration. A drill bit that is more suitable for drilling challenging formations such as conglomerates or formations including chert is also desirable.

U.S. Pat. No. 7,798,256 describes the provision of an ultrahard material coating provided on the bit body, blades and gauge pads of a drill bit.

SUMMARY

According to the present invention, there is provided a drill bit comprising: at least one blade, comprising a plurality of cutting elements in the form of polycrystalline diamond cutters disposed on a leading edge of the blade, at least one diamond impregnated cutting region, disposed behind the leading edge of the blade, and wherein at least one of the cutters disposed on the leading edge is an off-tip cutting element, arranged so that it does not engage with the formation during drilling until bit wear has taken place.

With such an arrangement, the off-tip cutter is initially protected from engagement with the formation, and so such an arrangement may result in the bit having an enhanced working life.

The polycrystalline diamond cutters may comprise a thermally stable polycrystalline diamond, and or may comprise compacts including a substrate and a polycrystalline diamond table bonded thereto. The off-tip cutting element conveniently has a shorter substrate than at least some of the other cutting elements disposed on the leading edge. Such an arrangement may allow manufacture to be simplified as location of a reduced axial length cutter within a standard size pocket will result in the cutter being provided in an off-tip position.

Preferably, the at least one diamond impregnated cutting region is disposed behind a cutting element on the leading edge of the blade, so as to sweep a substantially similar path, in use. The diamond impregnated cutting region may be provided behind the off-tip cutting element, arranged to engage with the formation before bit wear has taken place.

Preferably, there is a plurality of blades, the at least one off-tip cutting element of one of the blades being offset from the at least one off-tip cutting element of another of the blades, so as to sweep a different path, in use. The combined path swept by all the off-tip cutting elements of all the blades is preferably equivalent to at least that part of a single fully engaged blade of cutting elements located radially outward of a nose part of the drill bit.

The drill bit may be formed by powder metallurgy. The at least one blade preferably comprises a metal matrix material, at least part of which is impregnated with a diamond material to form the diamond impregnated cutting region. The diamond impregnated cutting regions are conveniently integrally formed with the blade.

The drill bit may include one or more blades not including an off-tip cutting element.

The drill bit may include a pilot portion and a reamer portion arranged coaxially with the pilot portion. Alternatively, the drill bit may be a bi-centre bit, having a pilot portion and a reamer portion located eccentrically to one another. In such arrangements, the at least one blade provided with the at least one off-tip cutting elements may form part of the pilot portion and/or part of the reamer portion. In another alternative, the drill bit may be adapted for case milling, or it may be applied to core bits and the like.

BRIEF DESCRIPTION OF THE DRAWINGS

The invention will further be described, by way of example, with reference to the following drawings in which.

DETAILED DESCRIPTION OF THE DRAWINGS

Figure 1:
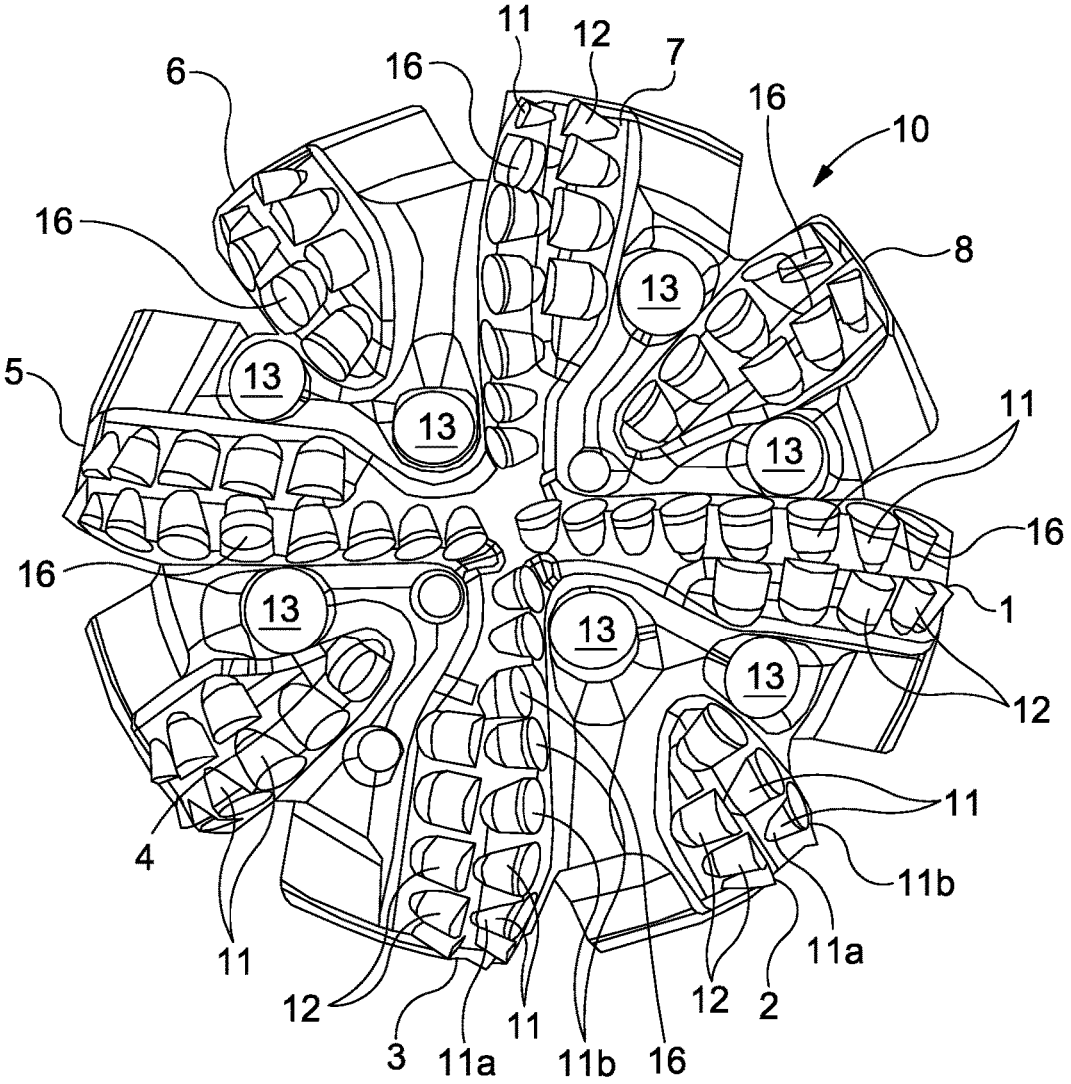
FIG. 1 is a schematic end view of a drill bit according to an embodiment of the invention.

In FIG. 1 a drill bit 10 is shown, comprising eight blades 1-8 formed integrally with a bit body. Alternate blades 1, 3, 5 and 7 extend from a rotational axis of the drill bit to the outer periphery of the bit, with the remaining blades 2, 4, 6, 8 each extending to the periphery from a position that radially outward of the axis. Each blade 1-8 is formed from a metal matrix material. Certain parts of each blade of the body (the extent of which is marked by a heavy solid line in FIG. 1) incorporate a diamond material and are shaped to define a plurality of cutting regions 12. Each cutting region 12 is of substantially part cylindrical shape, and has a flat, part circular cutting face.

The drill bit 10 is formed using powder metallurgy, wherein diamond particles are incorporated into the relevant parts of each blade region prior to sintering, and the blades 1-8 and bit body together being integrally formed following compaction and sintering. Pockets for accepting cutting elements are provided on the leading edge of each blade 1-8.

A plurality of polycrystalline diamond compact (PDC) cutting elements 11 are provided on the leading edge of each blade, brazed into the respective pockets formed in the bit body. The diamond impregnated cutting regions 12 which are integrally formed from the material of the blade 1-8 are each disposed on the respective blade in a position behind a respective PDC cutting element 11. Impregnated cutting regions 12 are provided behind each PDC cutting element 11 that is adjacent, or radially outward of the nose 15 of the bit 10. Each impregnated cutter 12 is disposed so as to sweep substantially the same cutting profile as the PDC cutter 11 that it is situated behind.

As is conventional, each PDC cutting element 11 comprises a polycrystalline diamond table 11*b* of generally circular shape integrally bonded to a cylindrical substrate 11*a* of, for example, tungsten carbide.

One of the PDC cutting elements 11 on each of blades 1 and 3-8 is an off-tip cutting element 16 which is arranged so that, prior to any wear of the drill bit 10, the off-tip element 16 does not engage with the formation. In the present embodiment, each cutting element or region 11, 12 is tilted such that a normal vector from the cutting face is inclined downhole. The off-tip cutting elements 16 take the form of PDC elements 11, the substrates 11*a* of which are of reduced axial length compared to the other elements 11 provided on the bit. Consequently, positioning of the elements 16 within standard size pockets formed on the bit body results in the off-tip positioning of the cutting edges of the elements 16, and hence in the elements 16 forming off-tip cutting elements. This approach means that the location and proportion of off-tip cutting elements can easily be changed without changing the bit body design, by brazing short substrate cutting elements into pockets as required. It will be appreciated, however, that the off-tip cutting elements 16 may be standard size cutting elements located within appropriately positioned pockets such that the cutting edges thereof are located in off-tip positions.

Figure 2:
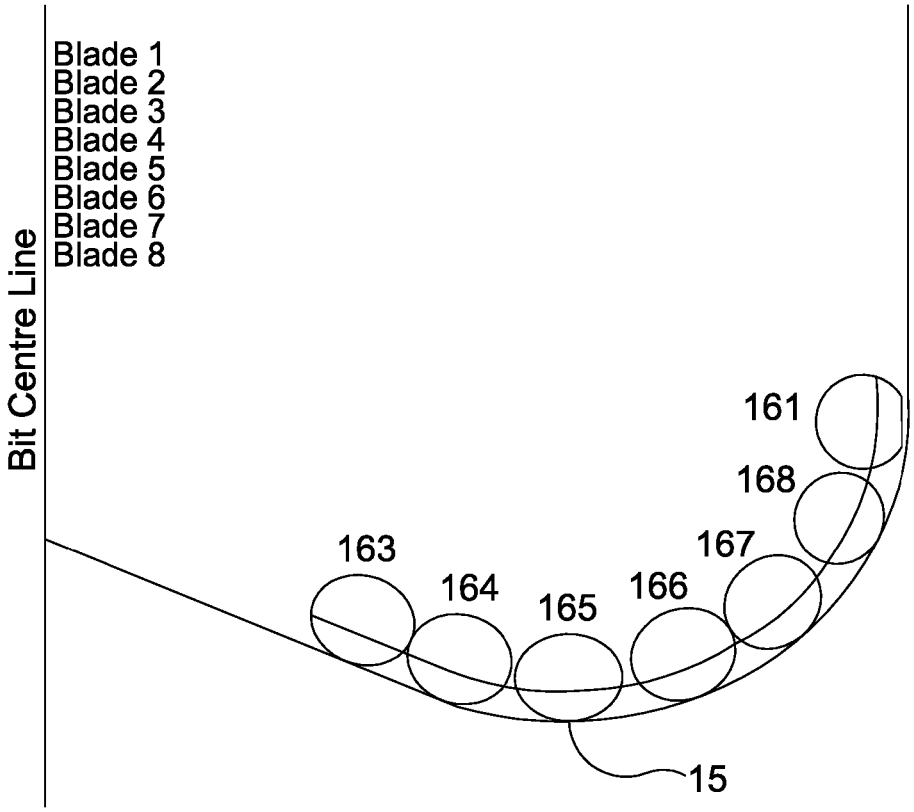
FIG. 2 is a schematic view showing the axial and radial location of each off-tip cutter according to an embodiment of the invention.

Each off-tip element 16 is positioned radially offset from the other off-tip elements 16. FIG. 2 shows the position of the off-tip cutting elements 161 and 163 to 168 of each respective blade 1 and 3-8 on a 2D plane defined by the drill bit axis and a radius of the drill bit 10. The off-tip cutting elements 161 and 163-168 combine to be substantially equivalent to at least that part of a single cutting blade located radially outward of the nose 15.

Whilst as illustrated each blade includes a single off-tip cutting element 16, more than one such element may be provided upon one or more of the blades, if desired. Furthermore, the drill bit may include one or more blades which do not have such an off-tip cutting element provided thereon.

The drill bit 10 further comprises nozzles 13, through which drilling mud can be circulated. Slots are provided between each blade, through which drilling mud carrying chips can flow away from the drill bit 10.

FIGS. 3*a* to 3*d* show how the cutting structure of the drill bit 10 works.

Figure 3A:
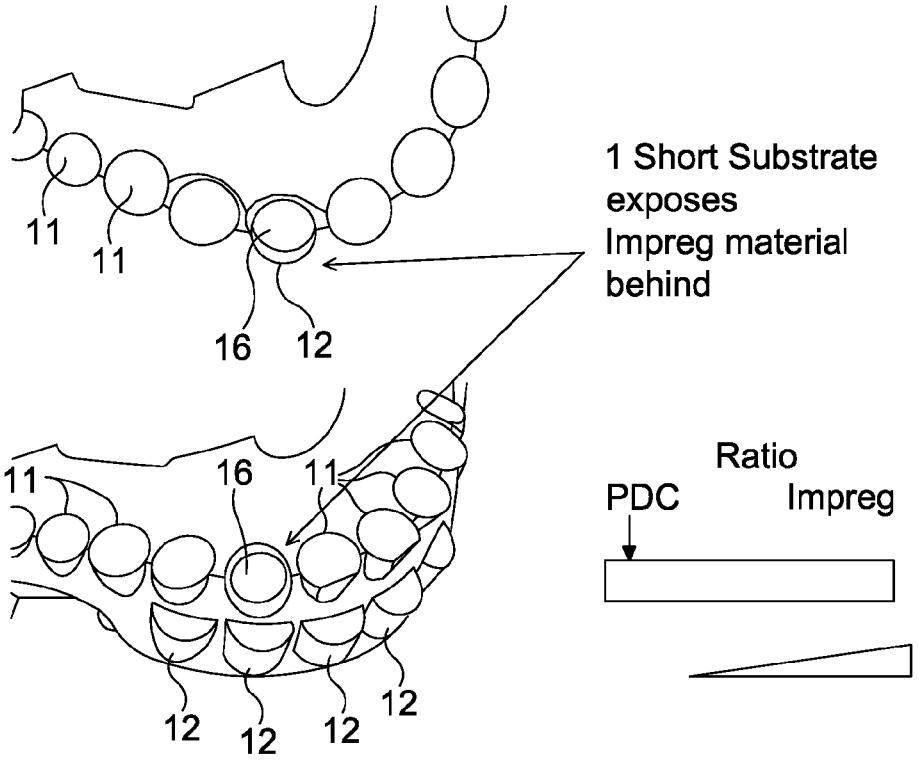
FIGS. 3*a* to 3*d* are a series of renderings showing cutting structure engagement for a drill bit according to an embodiment at various stages of wear.

FIG. 3*a* shows the bit 10 prior to any wear. Initially, the majority of the PDC cutting elements 11 on the leading edge engage with the formation, with the exception of the off-tip cutting element 16. The impregnated cutter regions 12 behind the full length substrate PDC cutting elements 11 are initially shielded by the PDC cutting elements 11. The off-tip cutting elements 16 are the exception, and because they are set back from the formation, the impregnated cutters 12 behind each off-tip cutter 16 does initially engage with the formation. Prior to any wear the drill bit 10 performs similarly to a conventional PDC bit, because of the high ratio of engagement of PDC cutting elements 11 to impregnated cutting elements 12. The bit 10 therefore benefits from a high initial rate of penetration.

Figure 3B:
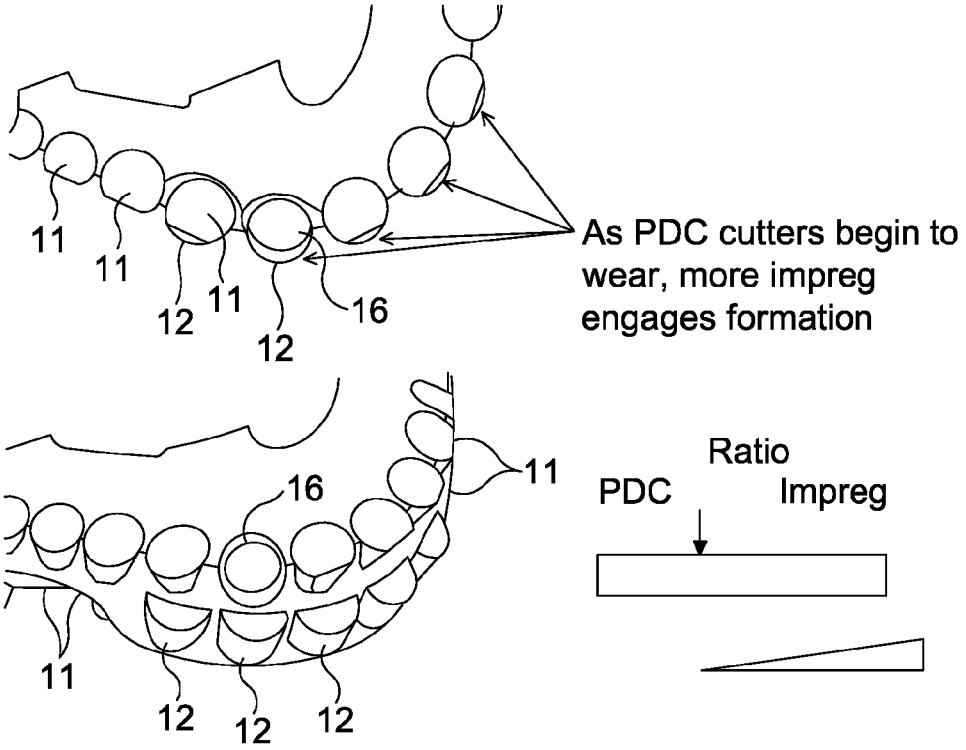

FIG. 3*b* shows the bit 10 after a small amount of wear. As the leading PDC cutting elements 11 wear, the impregnated cutter regions 12 behind them begin to engage the formation. The impregnated cutting regions 12 are more resistant to wear, and their engagement with the formation serves to reduce the rate of wear of the leading PDC cutting elements 11. In this state of wear the drill bit still has a high ratio of engagement of PDC cutting elements 11 to impregnated cutting regions 12.

Figure 3C:
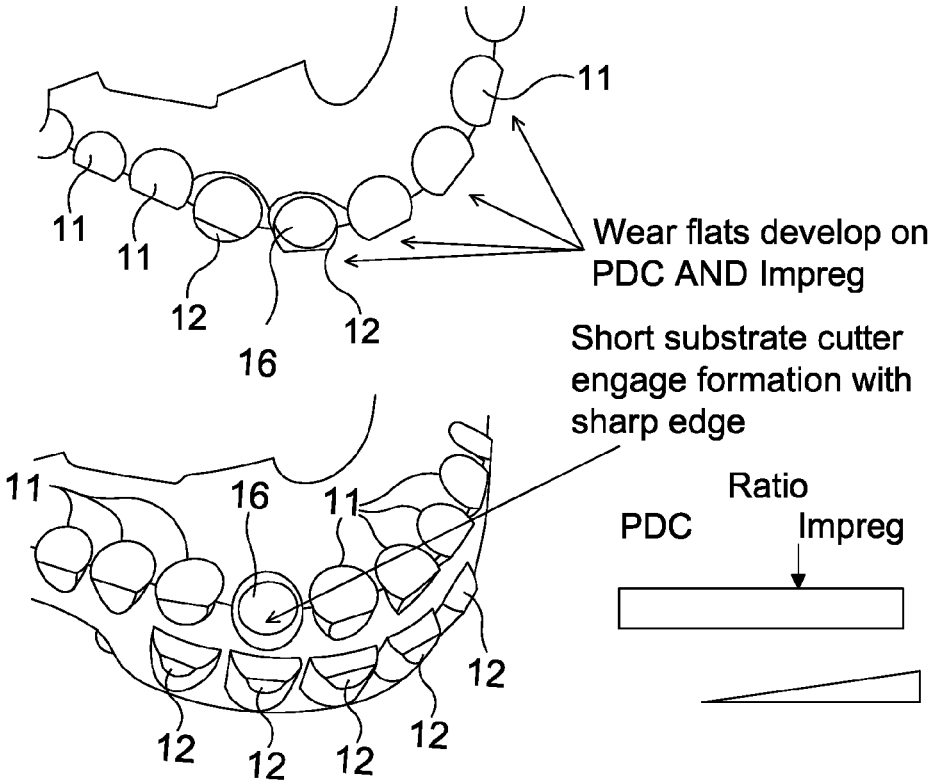

FIG. 3*c* shows the bit approximately halfway through its life, with wear flats developed on both the PDC and impregnated cutting elements or regions 11, 12. At this level of wear, the off-tip cutters 16 are brought into engagement with the formation. It will be appreciated that each off-tip cutter 16 has a sharp cutting edge, and has hitherto been substantially protected from damage or wear by the other cutting elements. The engagement of the off-tip cutters 16 help to maintain the PDC to impregnated cutting element engagement ratio, and furthermore help maintain a high rate of penetration late in the lifetime of the bit.

Figure 3D:
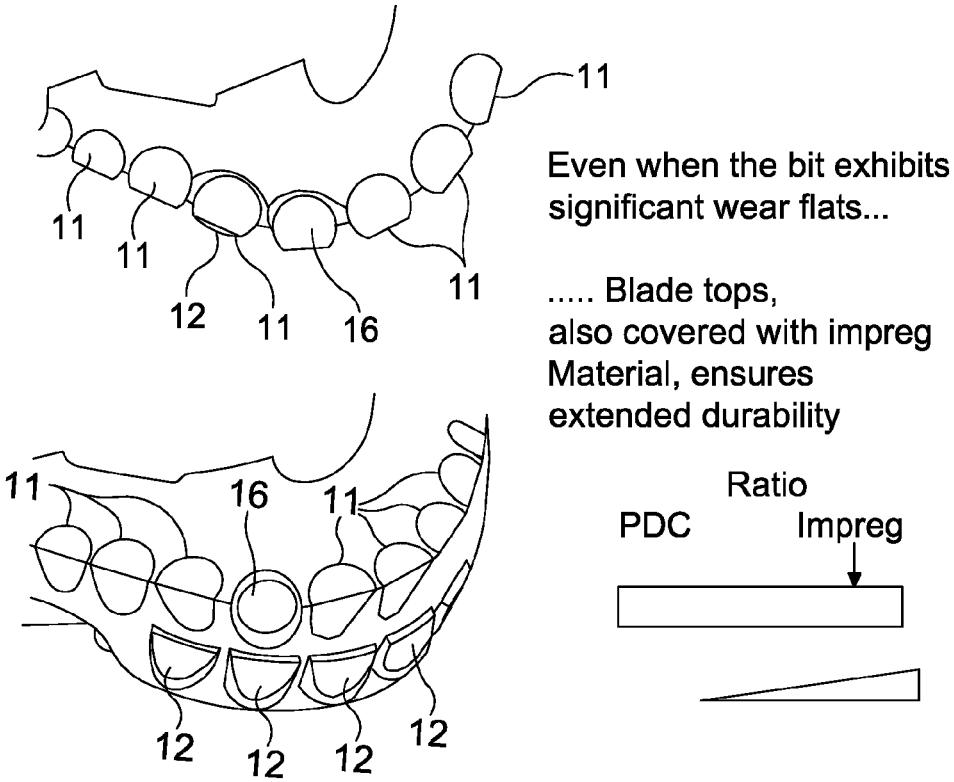

FIG. 3*d* shows the bit late in its life, with a significant degree of wear, having wear flats on all the PDC cutting elements 11, including the off-tip cutting regions 16, and on the diamond impregnated cutting elements 12. Because the blade is formed from diamond impregnated material, and the impregnated cutting regions 12 are unitarily formed therewith, the top of the impregnated cutting regions 12 and nose of each blade 1-8 are both highly resistant to wear, ensuring extended bit durability.

It will be appreciated that the number of off-tip cutting elements as a fraction of the total number of cutting elements can be varied as appropriate thereby varying the wear characteristics of the bit. An increased proportion of off-tip cutting elements would result in a lower PDC to impregnated cutter engagement ratio early in the lifetime of the bit, but would bring more PDC engagement later in the bit life. The initial rate of penetration for such a bit would be lower, but rates of penetration after significant wear would be improved. The relationship between rate of penetration and durability with wear can thereby be tailored to the requirements of the drill bit.

In the present embodiment the off-tip cutting elements are substantially evenly distributed over the blades, but it will be appreciated that this is not essential. In some embodiments the off-tip cutters may be concentrated on a subset of the blades.

In some embodiments, there may be impregnated cutting regions disposed on the leading edge of at least one blade.

In some embodiments, at least some impregnated cutting regions may be positioned behind PDC cutting elements such that they do not sweep the same cutting path.

Although in the example embodiment the off-tip cutting elements are achieved by using a short substrate, this is not essential. In some embodiments full sized substrates may be used in offset cutter element pockets, or the shape of the off-tip cutter varied so that it does not engage with the formation until some wear has taken place.

In some embodiments at least some (or all) of the PDC elements may instead comprise thermally stable polycrystalline.

Figure 4A:
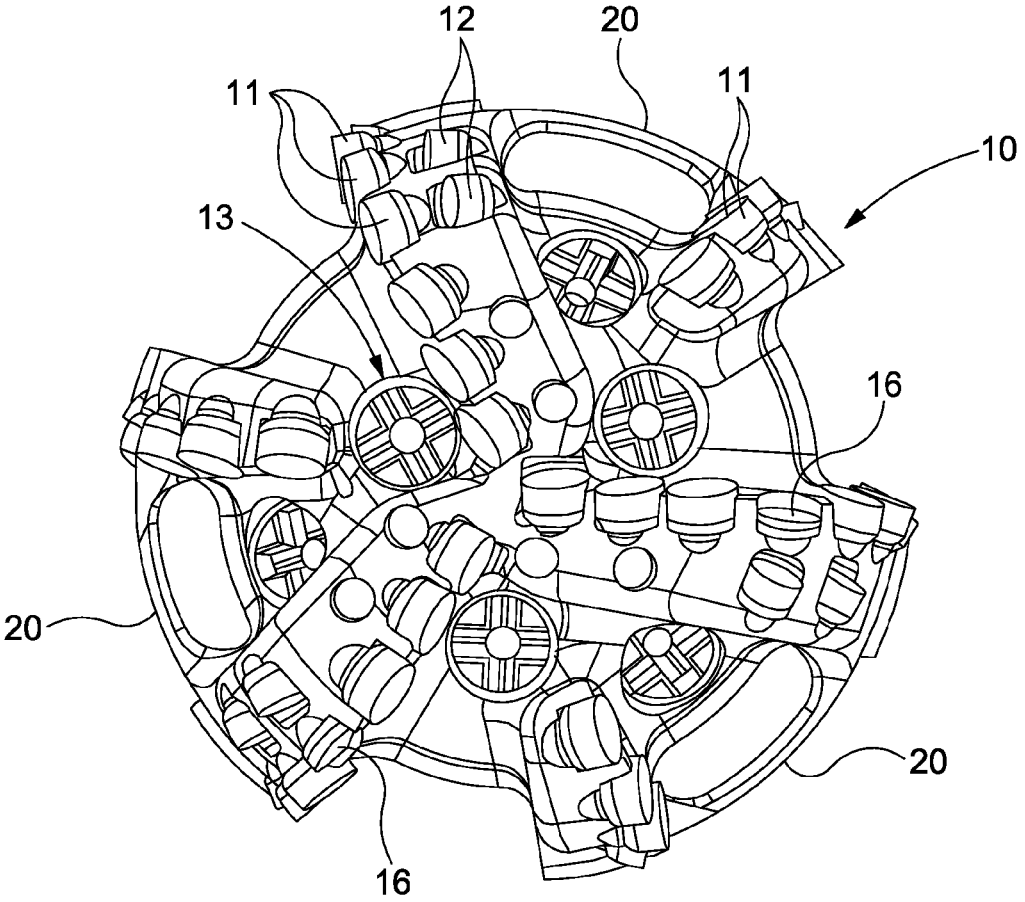
FIGS. 4*a* and 4*b* are views of an alternative drill bit in accordance with an embodiment of the invention.
Figure 4B:
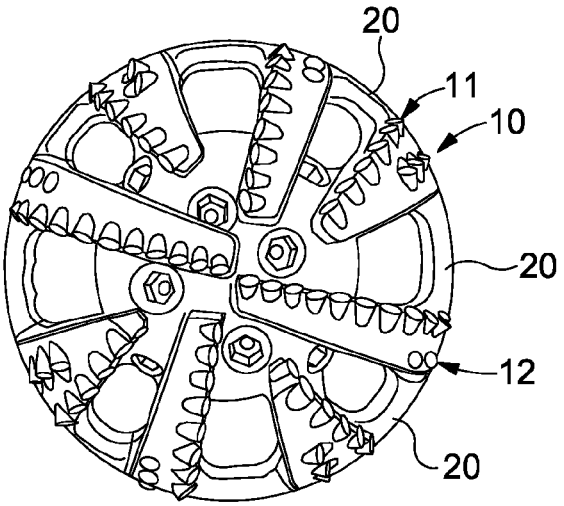

The invention as described hereinbefore may be applied to a wide range of designs and types of drill bit. By way of example, FIGS. 4*a* and 4*b* illustrate a drill bit sometimes referred to as a steering wheel bit which differs from the arrangement of FIG. 1 in that some or all of the slots between adjacent ones of the blades along or through which drilling fluid passes, in use, are bridged by parts 20 of the bit body, thereby extending the circumferential length of a gauge surface of the drill bit and so enhancing the stability of the drill bit. As shown most clearly in FIG. 4*a*, the drill bit includes a series of blades provided with cutting elements 11 disposed along a leading edge of the blade and cutting regions 12 disposed behind the leading edge of the blade, certain of the cutting elements provided at the leading edge of at least some of the blades being positioned so as to constitute off tip cutting elements 16 and so achieving the benefits of the invention.

Figure 5:
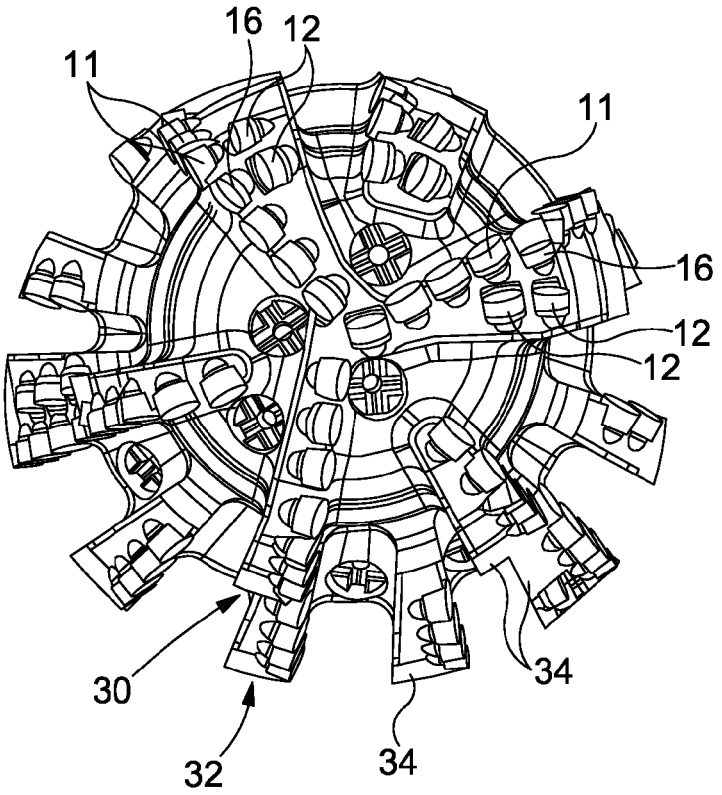
FIG. 5 is a view of a bi-centre bit in accordance with an embodiment of the invention.

In an alternative embodiment, as shown in FIG. 5, the drill bit may be a bi-centre drill bit, with a pilot section 30 and a reamer section 32. The reamer section 32 is located eccentrically relative to the pilot section 30. The pilot and/or reamer sections 30, 32 may comprise at least one blade 34 similar to those of the previous embodiments, in which PDC cutting elements 11 are disposed on a leading edge, at least one impregnated cutting element 12 is disposed behind a PDC cutting element on the leading edge, and further comprising an off-tip PDC cutting element 16.

In use, when the drill bit is rotated about the axis of the pilot section 30, it will be appreciated that the pilot section 30 drills a relatively small diameter hole, the diameter of which is subsequently extended by the operation of the eccentric reamer section 32. Whilst capable of drilling relatively large diameter holes, it will be appreciated that the drill bit is capable of being passed through holes of substantially the diameter of the reamer section 32.

Figure 6B:
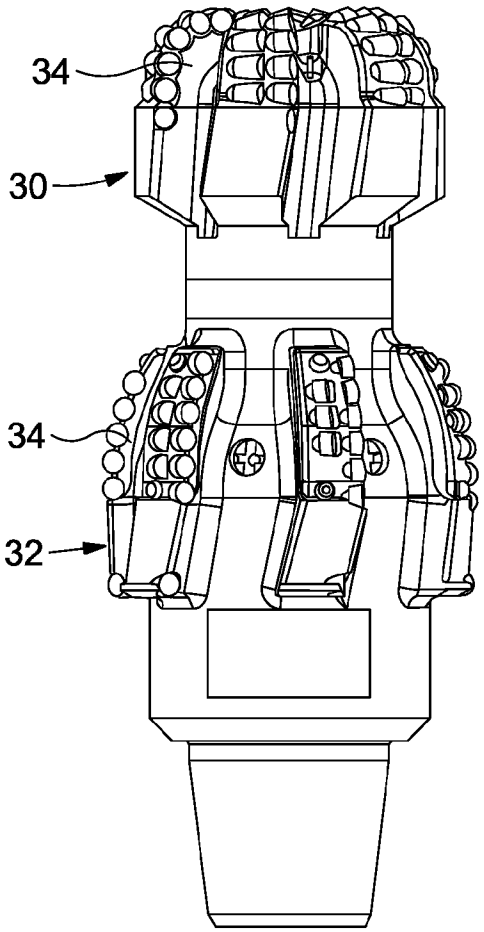
FIGS. 6*a* and 6*b* are views of a further form of drill bit in accordance with an embodiment of the invention.
Figure 6A:
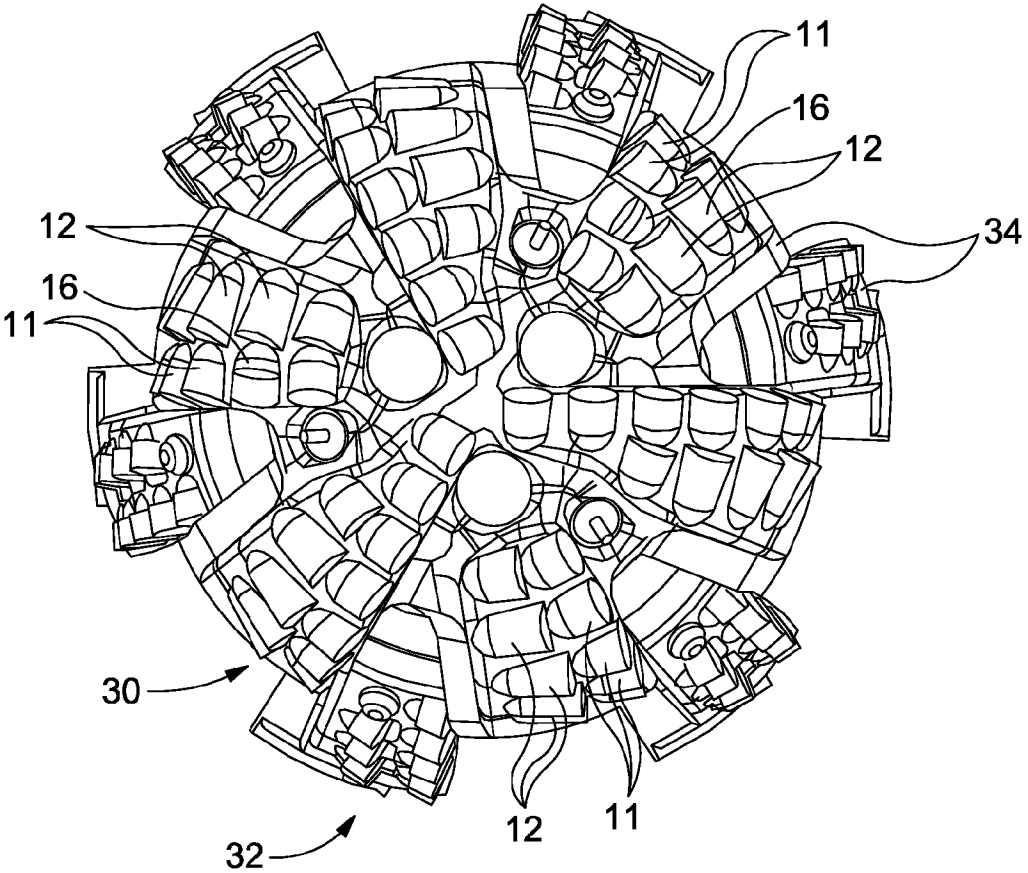

Alternatively, as shown in FIGS. 6*a* and 6*b*, the bit may include coaxially arranged pilot and reamer sections 30, 32, with the off-tip cutting elements 16 conveniently being provided on the blades 34 of the pilot section 30. Such a bit will tend to provide higher rates of penetration than conventional bits of the same radius, and this is thought to be because the borehole formed by the blades 34 of the pilot section 30 allows any stress in the formation to be relaxed before it is enlarged by the blades 34 of the reamer section 32. Because there are two cutting zones, and therefore two gauge portions, such bits tend to be more stable, for example being more resistant to string vibration, reducing bit whirl and having fewer cutter breakages. Such bits can be designed with significant cutter redundancy, and an increased number of junk slots, and are therefore more suitable for drilling difficult formations such as conglomerates.

As with the arrangements described hereinbefore, the blades carry cutting elements 11 located along the leading edge of the blade and cutting regions 12 disposed behind the leading edge, the off-tip cutting elements 16 being formed by appropriately positioned ones of the cutting elements 11.

The high durability offered by the disclosed arrangement of cutters can be used to further improve the performance of a bit, creating a bit that has very good rates of penetration and durability.

In the above described arrangements including pilot and reamer sections 30, 32, whether arranged concentrically or eccentrically, whilst the off-tip cutting elements 16 are only illustrated as being provided upon certain of the blades 34 of the pilot sections 30, it will be appreciated that these are merely examples and that the number of blades 34 provided with off-tip cutting elements 16, and the number of off-tip cutting elements 16 provided upon each blade 34 may be selected to suit the application in which the drill bit is being used. Furthermore, off-tip cutting elements 16 may be provided upon the blades 34 of the reamer section 32 in addition to, or instead of, being associated with the blades of the pilot section 30, if desired.

Figure 7:
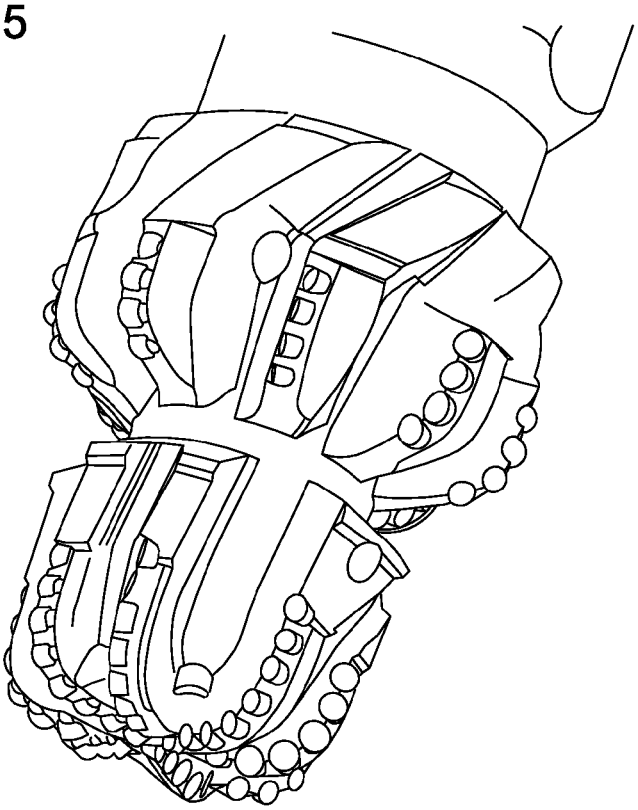
FIG. 7 is a view of a casing exit mill.

In some embodiments, the drill bit may be a casing mill, for forming an exit hole in a borehole casing. It will be appreciated that the design of the bit would be tailored as appropriate for this application, for instance by changing the shape and distribution of the cutting elements and/or blades and the like. FIG. 7 illustrates a casing exit mill, and it will be appreciated that the arrangement of FIG. 7 may be modified in accordance with the invention to achieve the benefits of the invention.

Figure 8A:
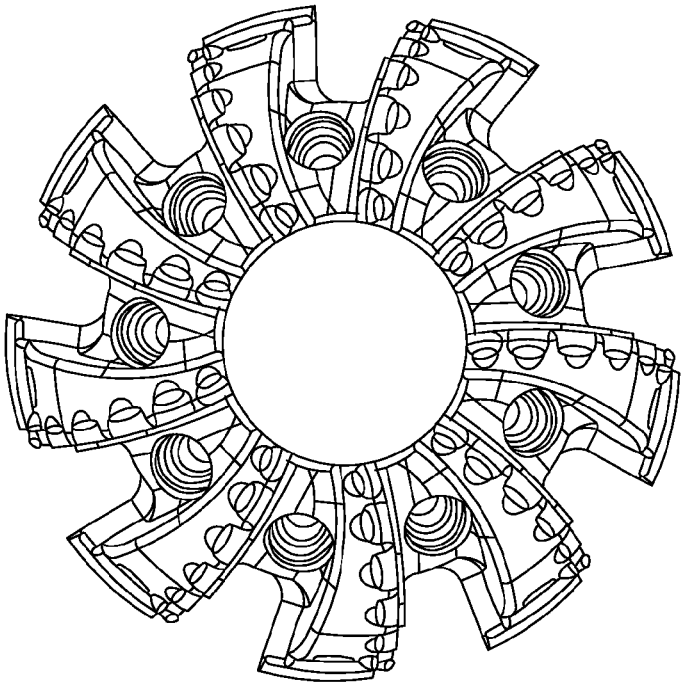
FIGS. 8*a* and 8*b* are views illustrating core bits.
Figure 8B:
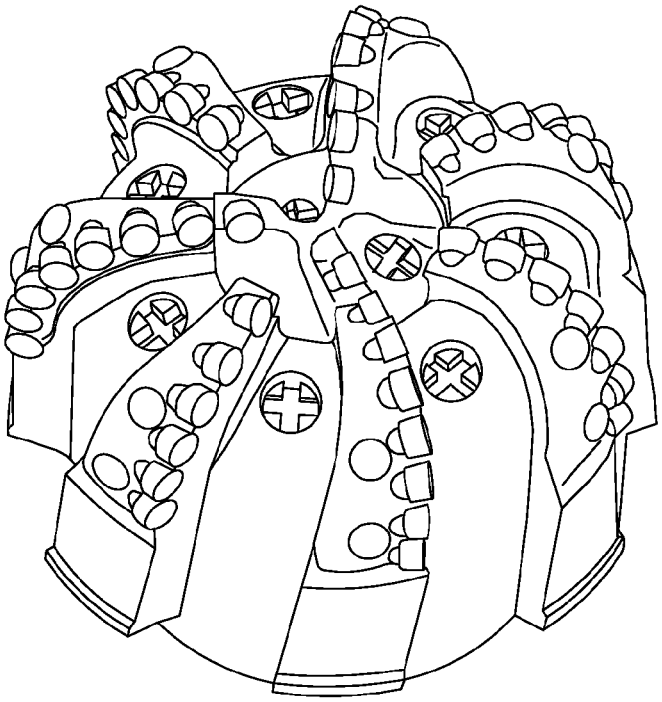

The invention may also be applied to other designs or types of bit such as core bits. FIGS. 8*a* and 8*b* illustrate examples of core bit, and it will be appreciated that these designs may be modified in accordance with the invention to supplement the cutting elements provided along the leading edge of each blade with associated diamond impregnated cutting regions located behind the leading edge, and to arrange that at least one of the cutting elements provided at the leading edge of at least one of the blades is positioned such that it forms an off-tip cutting element. A core bit modified in this manner is thought to have many of the advantages outlined hereinbefore.

Using drill bits according to embodiments of the invention, it is possible to drill formations in a single trip with good rates of penetration that would hitherto have required the use of an impregnated bit with inferior rates of penetration, or multiple trips to replace a worn PDC bit. The drill bit according to the present invention is particularly useful where a difficult formation is expected relatively deep in the borehole. The initial borehole may be formed with high rates of penetration with relatively low rates of wear on the PDC cutting elements. More rapid wear will take place when the bit enters the difficult formation, and rates of penetration will reduce but as the proportion of impregnated cutting elements engaged with the formation increases, the bit will begin to drill more like an impregnated bit: with a reduced rate of penetration, but with high resistance to wear. Embodiments of the invention can be used to significantly reduce the time taken to drill difficult formations.

Whilst specific embodiments of the invention have been described hereinbefore, it will be appreciated that a number of modifications and alterations may be made thereto without departing from the scope of the invention as defined by the appended claims.

The invention claimed is:

1. A drill bit comprising:

at least one blade, comprising:

a plurality of cutting elements in the form of polycrystalline diamond cutters disposed on a leading edge of the blade;

at least one diamond impregnated cutting region, disposed behind the leading edge of the blade, at least one of the cutters disposed on the leading edge being an off-tip cutting element, arranged so that it does not engage with the formation during drilling until bit wear has taken place;

wherein the polycrystalline diamond cutters comprise compacts each including a substrate and a polycrystalline diamond table bonded thereto, the off-tip cutting element having a shorter substrate than at least some of the other cutting elements disposed on the leading edge.

2. The drill bit according to claim 1, wherein polycrystalline diamond cutters comprises a thermally stable polycrystalline diamond.

3. The drill bit according to claim 1, wherein the at least one diamond impregnated cutting region is disposed behind a respective one of the plurality of cutting elements on the leading edge of the blade, so as to sweep a substantially similar path, in use.

4. The drill bit according to claim 3, wherein the at least one diamond impregnated cutting region is provided behind the off-tip cutting element, arranged to engage with the formation before bit wear has taken place.

5. The drill bit according to claim 1, wherein the at least one blade is a plurality of blades, and wherein the at least one off-tip cutting element of one of the blades is offset from the at least one off-tip cutting element of another of the blades, so as to sweep a different path, in use.

6. The drill bit according to claim 5, wherein the combined path swept by all the off-tip cutting elements of all the blades is equivalent to at least that part of a single fully engaged blade of cutting elements located radially outward of a nose of the drill bit.

7. The drill bit according to claim 5, wherein the combined path swept by all the off-tip cutting elements of all the blades is equivalent to a single fully engaged blade of cutting elements.

8. The drill bit according to claim 1, wherein the drill bit is formed by powder metallurgy.

9. The drill bit according to claim 8, wherein the at least one blade comprises a metal matrix material, at least part of which is impregnated with a diamond material to form the diamond impregnated cutting region.

10. The drill bit according to claim 9, wherein the diamond impregnated cutting regions are integrally formed with the blade.

11. The drill bit according to claim 1, wherein the drill bit includes a pilot portion and a reamer portion arranged coaxially with the pilot portion.

12. The drill bit according to claim 11, wherein the pilot portion and the reamer portion include respective series of blades, and at least one of the blades of the pilot portion is provided with an off-tip cutting element.

13. The drill bit according to claim 1, wherein the drill bit is a bi-centre bit, having a pilot portion and a reamer portion located eccentrically to the pilot portion.

14. The drill bit according to claim 1, wherein the drill bit is adapted for case milling or comprises a core bit.

15. The drill bit according to claim 1, wherein the drill bit includes at least one blade in which all of the cutters disposed on the leading edge of the blade are arranged to be at-tip cutters.

* * * * *